US007937804B2

(12) United States Patent
Charlton et al.

(10) Patent No.: US 7,937,804 B2
(45) Date of Patent: May 10, 2011

(54) BELT LIFTER MECHANISM FOR VACUUM CLEANER

(75) Inventors: Chris Charlton, Medina, OH (US); Steven Wang Pi Wen, Lanzhou (CN); Ng Wing Leung, Kowloon (HK)

(73) Assignee: Royal Appliance Mfg. Co., Glenwillow, OH (US)

( * ) Notice: Subject to any disclaimer, the term of this patent is extended or adjusted under 35 U.S.C. 154(b) by 0 days.

(21) Appl. No.: 12/420,779

(22) Filed: Apr. 8, 2009

(65) Prior Publication Data

US 2009/0249580 A1 Oct. 8, 2009

Related U.S. Application Data

(60) Provisional application No. 61/043,213, filed on Apr. 8, 2008.

(51) Int. Cl.
*A47L 5/10* (2006.01)
*A47L 5/26* (2006.01)

(52) U.S. Cl. ..... 15/390; 15/391

(58) Field of Classification Search ..... 15/389–391, 15/332, 333
See application file for complete search history.

(56) References Cited

U.S. PATENT DOCUMENTS

| | | | | |
|---|---|---|---|---|
| 1,218,134 | A | 3/1917 | Tyler | |
| 1,309,093 | A | 7/1919 | Hoover | |
| 1,462,046 | A | 7/1923 | Reddig | |
| 1,498,383 | A | 6/1924 | Kelly | |
| 1,641,063 | A | 8/1927 | Blanch et al. | |
| 1,797,119 | A | 3/1931 | Beckwith | |
| 2,037,648 | A | 4/1936 | Bergstrom | |
| 3,581,591 | A * | 6/1971 | Ziegler et al. | 74/377 |
| 3,646,632 | A | 3/1972 | MacFarland | |
| 4,068,341 | A | 1/1978 | Scott et al. | |
| 4,235,321 | A | 11/1980 | Stein | |
| 4,317,253 | A | 3/1982 | Gut et al. | |
| 4,648,150 | A | 3/1987 | Morishita et al. | |
| 5,115,537 | A | 5/1992 | Meyer et al. | |
| 5,335,740 | A | 8/1994 | Meyer et al. | |
| 5,713,810 | A | 2/1998 | Fedorka et al. | |
| 6,067,689 | A | 5/2000 | Roney et al. | |
| 6,098,243 | A | 8/2000 | Kim | |
| 6,374,453 | B1 | 4/2002 | Kim | |
| 6,523,222 | B2 | 2/2003 | Vystrcil et al. | |
| 6,691,849 | B1 | 2/2004 | Dyson et al. | |
| 6,711,777 | B2 | 3/2004 | Frederick et al. | |
| 7,107,647 | B2 | 9/2006 | Park | |

(Continued)

OTHER PUBLICATIONS

Riccar/Tacony clutch mechanism photos, photos of Riccar Belt Shutoff System (Switch—Floor/Carpet), Carpet (Brushroll spinning), and Bare Floor Setting (Brushroll not spinning), sent by John Laguardia (formally of TTI), at least as early Jan. 2007.

*Primary Examiner* — Dung Van Nguyen
(74) *Attorney, Agent, or Firm* — Michael Best & Friedrich LLP

(57) ABSTRACT

A drive belt shifting arrangement for a rotatable brush roller of an upright cleaner where the shifter has an idler pulley for arcuate movement within the loop of the belt between the roller and the motor occasioned by pedal actuation. The same pedal action by the user alternately cams the belt onto the idler pulley to discontinue roller rotation or to permit its movement back to the motor shaft to allow roller rotation.

18 Claims, 8 Drawing Sheets

U.S. PATENT DOCUMENTS

| | | | | |
|---|---|---|---|---|
| 7,120,964 | B2 | 10/2006 | Roney | |
| 7,318,250 | B2 * | 1/2008 | Roney | 15/391 |
| 7,426,770 | B2 * | 9/2008 | Moon | 15/390 |
| 7,562,415 | B2 * | 7/2009 | Moon | 15/389 |
| 7,694,385 | B2 * | 4/2010 | Choi et al. | 15/391 |
| 2007/0056137 | A1 | 3/2007 | Miner et al. | |

* cited by examiner

BELT LIFTER MECHANISM FOR VACUUM CLEANER

This application claims the benefit to U.S. provisional patent application entitled "BELT LIFTER MECHANISM FOR VACUUM CLEANER" having Ser. No. 61/043,213 filed Apr. 8, 2008, which is incorporated herein by reference in its entirety.

TECHNICAL FIELD

The present disclosure relates to floor cleaning appliances with a belt shifting arrangement, more particularly to an upright cleaner such as vacuum cleaners, bare floor suction cleaners like extractors having a motor driven floor engaging roller brush. Some of these vacuum cleaners have a mechanism for disengaging the roller brush while continuing to run the motor for generating vacuum for cleaning as, for example, where it is desired to use hose attachments rather than the floor engaging roller brush.

Heretofore, various mechanisms have been utilized for enabling the user to engage and disengage the roller brush; and, in particular, foot operated actuators have been provided for such engagement and disengagement for user convenience. An example of such a device is the belt lifter or shifter mechanism described in U.S. Pat. No. 6,067,689 in which a foot operated actuator is moved downwardly by foot pressure for disengagement and lifted up by pulling with the foot to move the actuator upwardly through an arc of up to about 110 degrees. This type of actuator movement, namely, the pulling upward with the user's foot in addition to the arcuate length of the foot movement, has been deemed to be somewhat awkward and, thus, it has been desired to improve the convenience of the engagement and disengagement of the roller brush in an upright vacuum cleaner.

BRIEF DESCRIPTION

The present disclosure provides a belt lifter or engaging and disengaging mechanism for the roller brush of a floor cleaning appliance where in one embodiment is a vacuum cleaner, particularly an upright vacuum cleaner. The belt lifter or engaging and disengaging mechanism is provided in a manner which addresses the problems of the awkwardness of the foot operated actuator of the known vacuum cleaners. The belt lifter or clutching mechanism of the present disclosure utilizes a foot operated pedal having a relatively short stroke which enables the user to disengage the roller brush from the motor by a short downward stroke of the actuator and to engage the drive belt on the motor for driving the roller brush by a second relatively short downward stroke of the actuator. This provides a more convenient and user acceptable foot operated actuator for an upright vacuum cleaner where it is desired to disengage the roller brush drive while the vacuum motor continues to operate.

In one embodiment of the present disclosure the belt lifter or shifter has a support mounting plate for attachment to the floor cleaning appliance, a arcuate movable clutch actuator with a user accessible pedal at one end, and clutch lever operatively associated with the actuator having a belt engaging arcuate surface. All three have openings sufficient for a motor shaft to pass through them where the openings can range from apertures to curved unconnected ends of each. The mounting plate has stops to limit the arcuate movement of the clutch lever and locking members to hold the idler pulley is either and engaged position with the belt or a disengaged position with the belt upon user activation of the pedal.

DETAILED DESCRIPTION OF THE EMBODIMENTS

Before any embodiments of the inventive disclosure are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. In addition other than where otherwise indicated, all numbers expressing quantities of physical properties and parameters and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claims, each numerical value should at least be construed in light of the number of reported significant digits and by applying ordinary rounding techniques. Moreover, all ranges disclosed herein are to be understood to encompass the beginning and ending range values and any and all sub-ranges subsumed therein.

Figure 1:
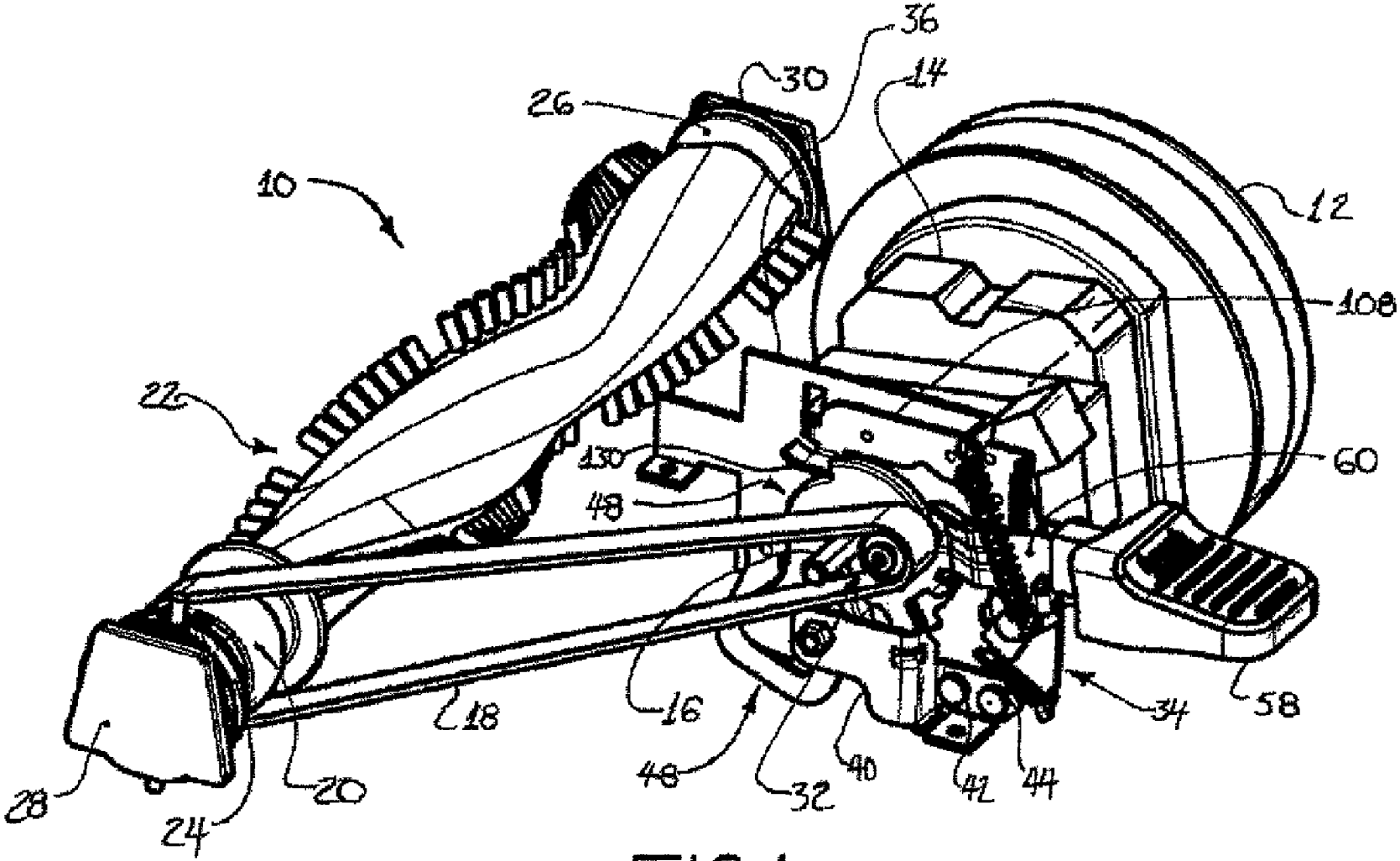
FIG. 1 is a perspective view of the roller brush drive train assembly for an upright vacuum cleaner in an exemplary embodiment with the drive belt disengaged.
Figure 2:
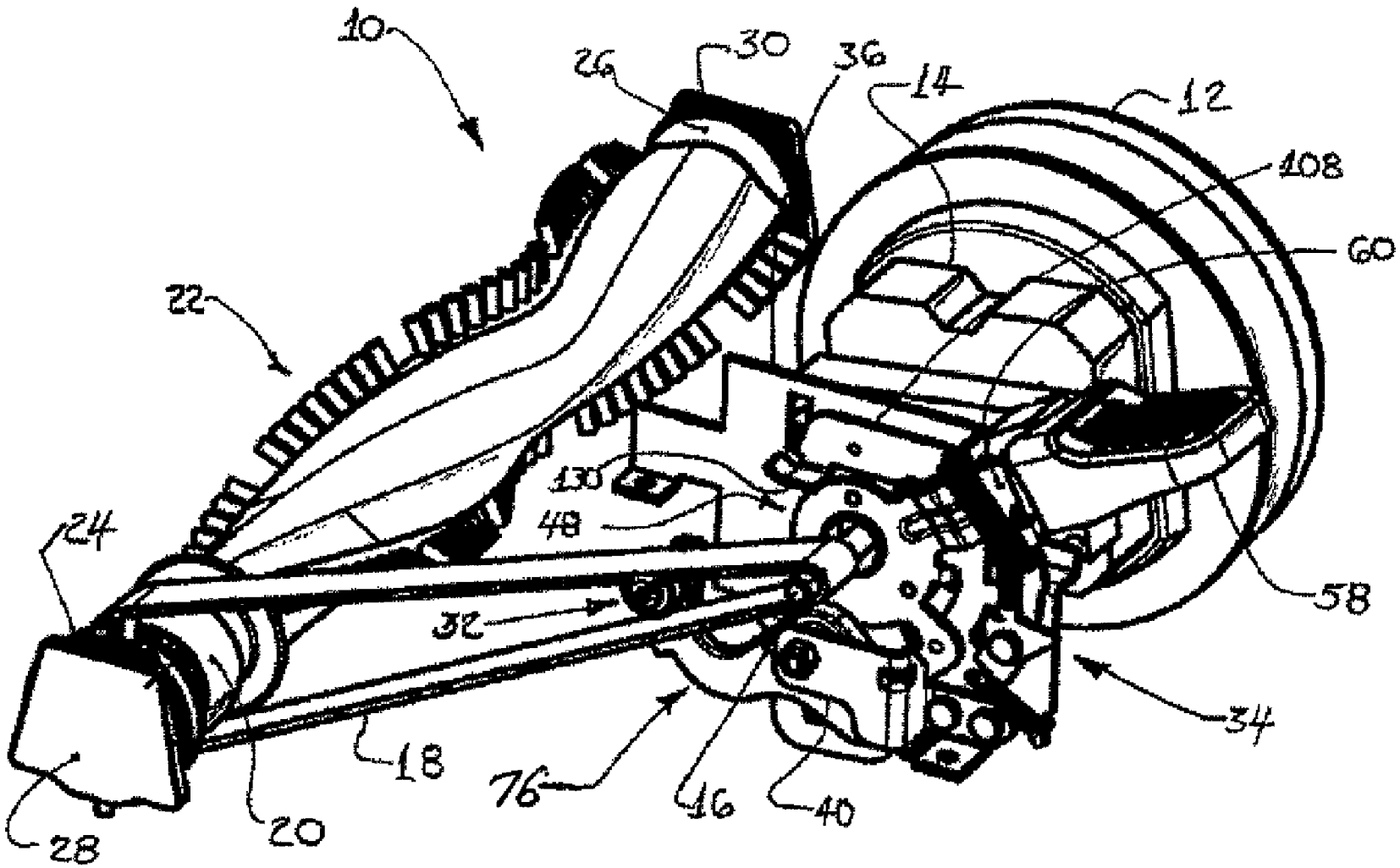
FIG. 2 is a view similar to FIG. 1 with the mechanism moved to the position with the drive belt engaged for driving the roller brush.
Figure 7:
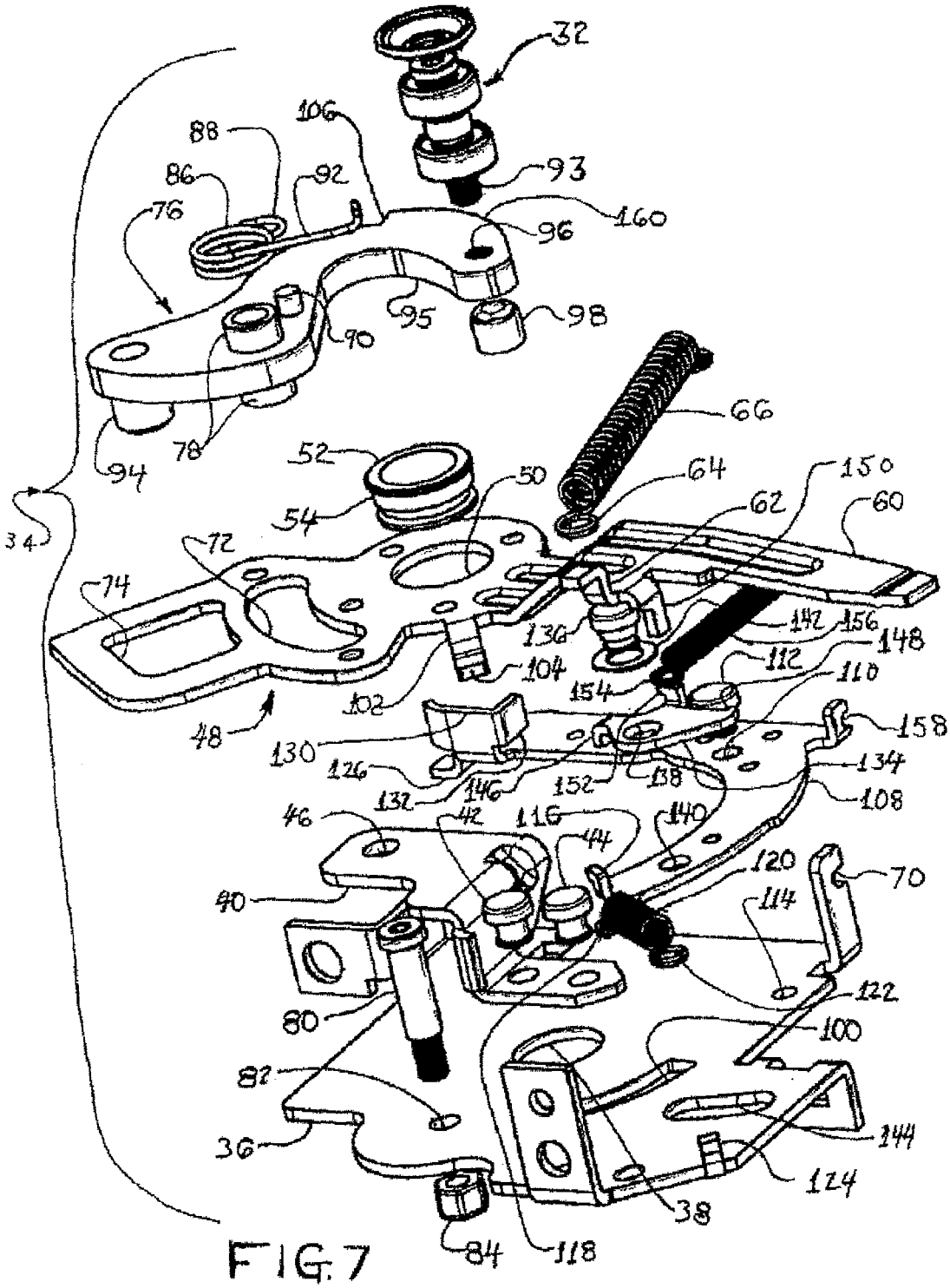

Embodiments of the disclosure relate to floor cleaning appliances suitable examples are depicted in the drawings where similar parts and elements have the same reference number where appropriate. FIG. 1 Referring to FIG. 1, a drive train for a belt driven roller brush of a vacuum cleaner is indicated generally at 10 and includes a vacuum generating drive motor 12 mounted to a portion of the vacuum cleaner structure 14 with a drive shaft 16 extending therethrough and outwardly thereof. A drive belt 18 operative to engage the motor shaft 16 engages a driven pulley 20 on a roller brush assembly indicated generally at 22 which is journalled for rotation on bearings 24, 26 provided on end plates 28, 30 which it will be understood are adapted for attachment to the vacuum cleaner structure (not shown). Known drive belts are typically formed of elastomeric material capable of about 25 percent elongation without breaking. Suitable non-exclusive examples of belts include flat belts, belts with v-shaped or u-shaped or rectangular cross-sectional shapes, cogged, and multiple longitudinal V-type belts, like Poly-V belts. The drive belt 18 is shown in FIG. 1 as having an end opposite the roller brush pulley 20 disposed over an idler pulley 32. Drive belt 18 may be stretched between motor shaft 16 and pulley 20, such that it's natural elasticity maintains drive belt 18 under tension for transmitting power from motor 12 to brush roller 22. The idler pulley 32, as will hereinafter be described in detail, is mounted on a belt lifter or clutch mechanism indicated generally at 34. As can be seen in FIG. 7, the lifter mechanism 34 includes a support frame or mounting plate 36 having an aperture 38 formed therein which is received over motor shaft 16 and secured to the vacuum cleaner structure 14. FIG. 1 shows the drive belt disengaged from the drive motor; and, FIG. 2 shows the belt engaged with the motor for driving roller brush 22.

Referring to FIGS. 3-7, attached at one end of the mounting plate 36 is a support bracket 40, by suitable fasteners as, for example, rivets 42, 44. The bracket 40 has an end thereof extending generally parallel to the surface of plate 36 and with an aperture 46 formed therein adjacent the opposite free end.

An actuator member indicated generally at 48, has a pivot aperture 50 formed therein intermediate to the ends thereof. Received through the rivet aperture 50 is a retainer bushing 52 which has bearing surface 54 engaged in aperture 50, with the lower end of the bushing 52 secured through the aperture 38 in frame 36 by any suitable expedient, as for example weldment or riveting or orbital staking. Thus, actuator 48 is free to pivot about bearing surface 54 when assembled to the frame 36. With references to FIGS. 1 and 2, actuator 48 has a pedal 58 provided on the end of an arm 60 thereof for user depression. However, the pedal has been omitted from FIGS. 3 through 7 for clarity of illustration.

Actuator arm 60 has a tab or lug 62 formed thereon. Engaged on the lug 62 is one end 64 of a tension spring 66, which has its opposite end 68 engaged with a similar tab 70 formed on the support frame 36. Spring 66 thus biases the actuator 48 and arm 60 in a counterclockwise direction about the bushing 52.

A portion of actuator 48 disposed on the opposite side from arm 60 includes an arcuate slot 72 formed therein, which is generally of constant radius and concentric with the bushing bearing surface 54. Actuator 48 also includes a second slot 74 with a generally rectangular configuration formed therein radially outwardly of the arcuate slot 72. The configuration and disposition of the slots 72 and 74 are shown clearly in FIG. 7.

A clutch lever indicated generally at 76 has a hub 78 formed thereon and extending axially therefrom on opposite sides thereof. Hub 78 is disposed between the free end of bracket 40 and the mounting frame 36. A shouldered bolt 80 is received through hub 78 and aperture 46 in bracket 40 and through aperture 82 in frame 36 and is secured therein by any suitable expedient such as threaded nut 84. Thus, clutch lever 76 is freely pivoted about the larger diameter portion of bolt 80. A torsion spring 86 is provided about the hub 78 on lever 76 with one end of the torsion spring 88 engaging a projection 90 extending from lever 76. An opposite end 92 of spring 86 engages the edge of bracket 40 in an arrangement which thus biases the lever 76 in a counterclockwise direction about the bolt 80.

Clutch lever 76 has on one end thereof, a projection or lug 94 extending from the inner face of the lever 76 and into the slot 74 on actuator 48 for limited lost motion movement therein. The end of lever 76 opposite lug 94 from hub 78 has a generally hooked or U-shaped configuration with the idler pulley 32 mounted on the end thereof by a suitable expedient. For example, bolt 93 extends through an aperture 96 in the end of the lever 76 and is retained thereon by nut 98. A curved portion 95 of clutch lever 76 is configured to avoid interference with bushing 52 and the motor shaft 16 yet provide a wide arc of movement to the lever 76 for positioning idler pulley 32 on opposite sides of motor shaft 16 and centered on a line passing through the axis of motor shaft 16 and the axis of roller brush 22.

Figure 3:
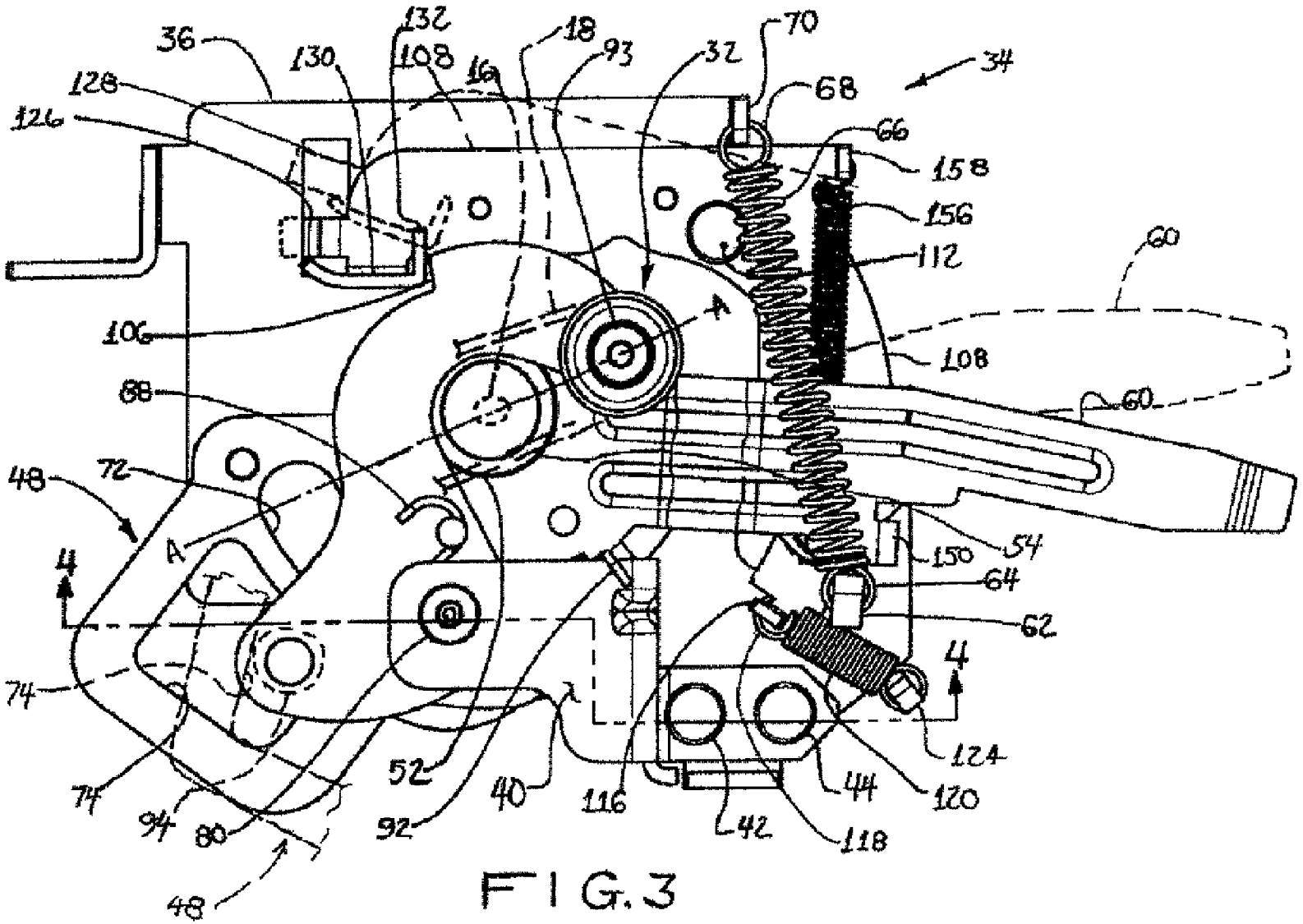
FIG. 3 is a front elevation view of the belt lift or clutching mechanism of the embodiment of FIG. 1 in the disengaged position.
Figure 4:
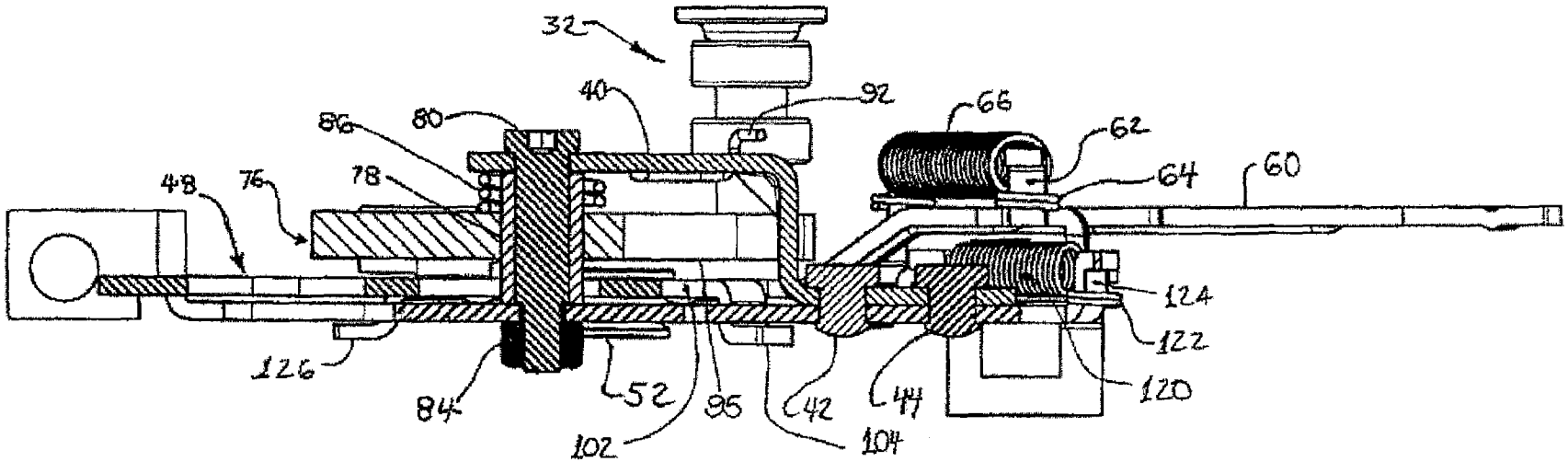
FIG. 4 is a section view taken along section indicating line 4-4 of FIG. 3.
Figure 5:
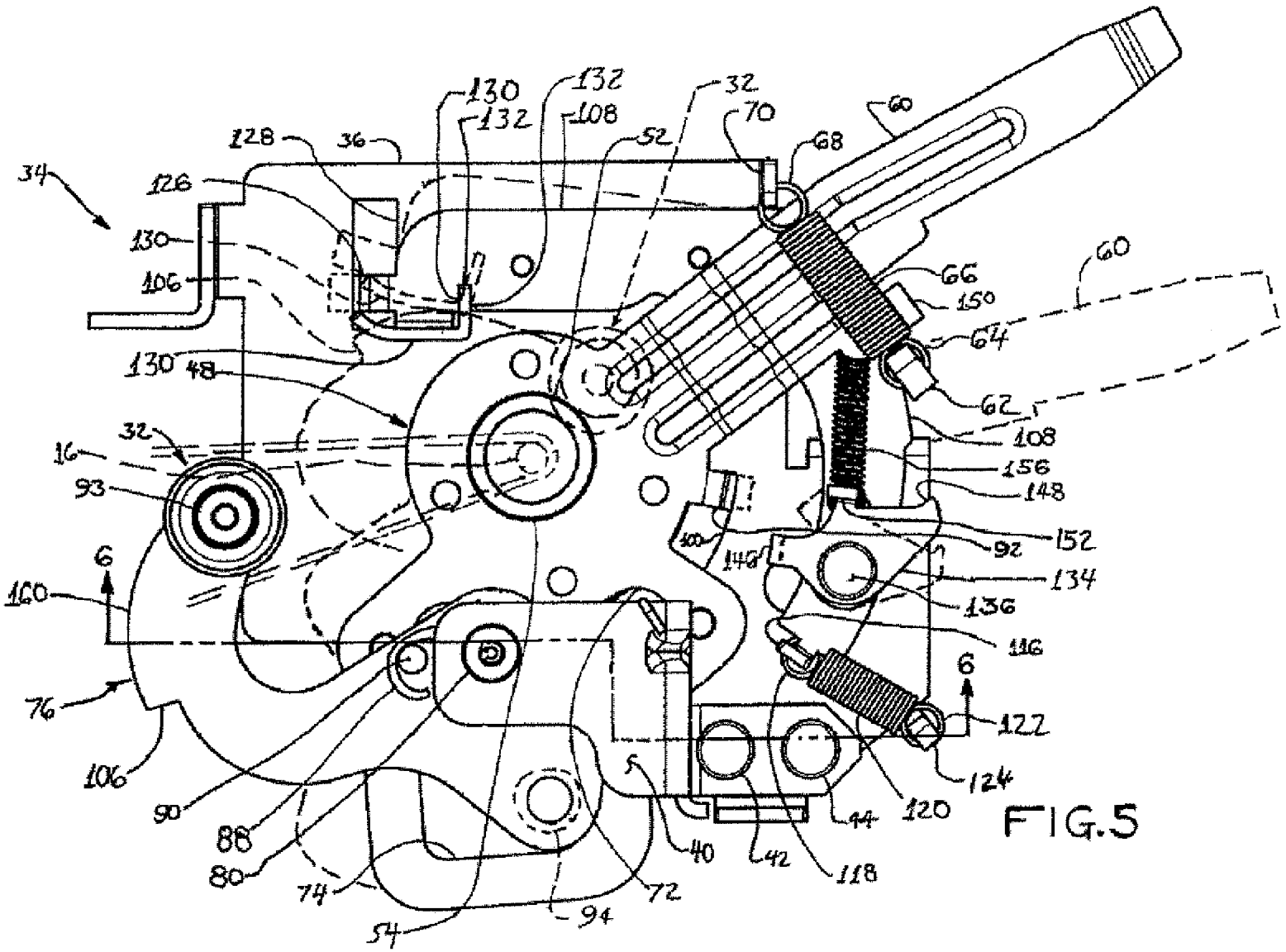
FIG. 5 is a view similar to FIG. 3 showing the belt lifter mechanism in the position with the belt engaged as shown in FIG. 2.
Figure 6:
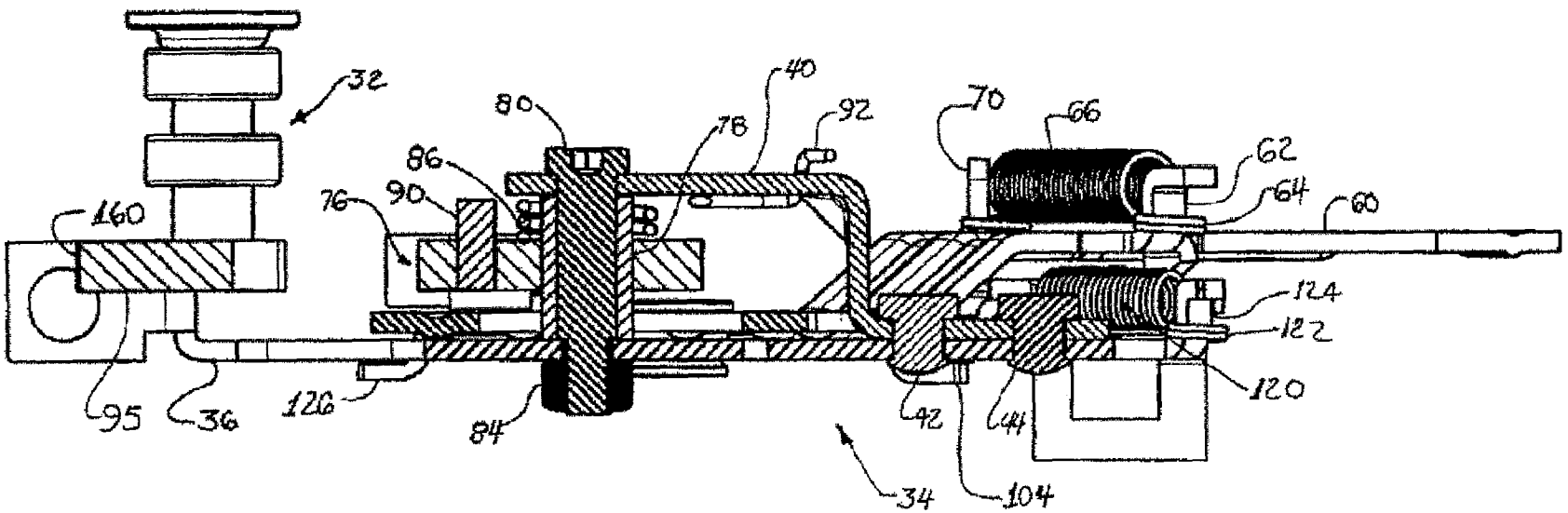
FIG. 6 is a section view taken along section indicating line 6-6 of FIG. 5; and, FIG. 7 is an exploded perspective view of the belt lifter or clutch mechanism of the present exemplary embodiment.

Mounting frame 36 has an arcuate slot 100 formed therein as shown in FIGS. 3, 5 and 7. Actuator member 48 has a tab or lug 102 formed thereon arcuately intermediate the arm 60 and slot 74. Tab 102 extends into and engages slot 100 with the end 104 of tab 102 formed or bent to register in a sliding manner on the inner face of frame 36 for guiding movement of actuator 48.

The clutch lever 76 has a detent or locking surface 106 formed on the outer periphery thereof on the side opposite the curved portion 95. The surface 106 extends generally radially with respect to bolt 80. It is located intermediate the hub 78 and aperture 96 and serves an engaging function such as a latching function, as will hereinafter be described in greater detail.

Also provided is a locking member 108, having a generally L-shaped configuration. Member 108 has an aperture 110 formed at the junction of a pair of arms thereof or generally in the central region. The member 108 is pivotally mounted on frame 36 by a rivet 112 passing through aperture 110 in the lever and a corresponding aperture 114 formed in the frame 36. Member 108 has a lug or tab 116, which has one end 118 of a tension spring 120 engaged thereon. An opposite end 122 of spring 120 engages a corresponding lug or tab 124 provided on the edge of frame 36. Spring 120 thus biases lever 108 in a counterclockwise direction pivotally about rivet 112.

The end of member 108 on the opposite side from spring 120 has a lug or tab 126 formed thereon. This tab extends through slot 128 formed in frame 36, as shown in FIGS. 3-6, with the end of the tab 126 formed or configured to engage the inner surface of frame 36 in a sliding engagement. This design prevents a deflection of member 108 away from the frame 36. Member 108 has another lug or tab 130 extending therefrom on the end thereof adjacent tab 126. The tab or lug 130 extends from the member 108 in the direction away from plate 36, and has a right angle formed at the end 132 thereof. The end 132 of tab 130 serves to engage the latching surface 106 on clutch lever 76 as will hereinafter be described.

Referring to FIG. 7, an actuator stop member 134 is pivotally mounted on locking member 108 by a fastener such as rivet 136 passing through aperture 138 formed in the member 134 and an aligned aperture 140 formed in the member 108.

A spacer washer 142 is disposed between the stop member 134 and locking member 108, which facilitates free rotation of the stop member upon rivet 136 mounted on the locking member 108. A clearance slot 144 is provided in support frame 36 to permit movement of the end of the rivet as the locking member 108 moves to prevent the end of the rivet from engaging the frame 36. Stop member 134 has a tab 146 formed on an end thereof, which extends downwardly toward the member 108. It is operative to engage the edge of member 108, as will hereinafter be described. The end of stop member 134 on the opposite side of the aperture 138 from tab 146 has a pawl 148 formed thereon. The pawl 148 serves to be engaged by a downwardly extending tab 150 formed on the actuator arm 60 of actuator 48, in a manner which will hereinafter be described.

Actuator stop member 134 also has an upwardly extending tab or lug 152 formed thereon intermediate the tab 146 and pawl 148. The tab 152 is used to mount 5 one end 154 of a tension spring 156. Referring to FIG. 3, the opposite end of spring 156 is connected to a tab 158 provided on the locking member 108, which tab 158 is positioned at a relatively short distance from rivet 112. Spring 156 is operative to bias the stop member 134 in a counterclockwise direction about the rivet 136.

Referring to FIGS. 2 and 5, the clutch mechanism 34 is shown with the belt 18 engaging the motor shaft 16, with the belt shown in dashed outline in FIG. 5. The clutch actuator lever 48 is shown rotated to its fully counterclockwise position in solid outline. Further movement thereof is prevented by the tab 152 engaging the upper end of the slot 100 formed in the frame 36. The clutch lever 76 is rotated to its fully counterclockwise position under the urging of torsion spring 86, with the lug 94 on lever 76 engaging the right hand side of slot 74 in the actuator lever 48, thereby preventing further movement of the member 76.

When the operator of the vacuum cleaner desires to disengage the roller brush 22 from the drive motor, the operator depresses the pedal 58 to push the arm 60 downwardly, effecting clockwise rotation of the actuator member 48 about the bushing 54. This causes the slot 74 of the actuator arm 48 to bear against the lug 94 and rotate the clutch lever 76 in a clockwise direction about the bolt 80. Such movement causes a cam surface 160 on the clutch lever 76 to bear against the tab 130 on member 108. This movement lifts the tab 130 to the position shown in dashed outline, by clockwise rotation of the member 108 about rivet 112. Further downward movement of arm 60 causes the slot 74 in the actuator 48 to move the clutch lever 76 to the position shown in solid outline in FIG. 3 whereupon the bias of spring 120 causes member 108 to rotate in the counterclockwise direction, causing tab 132 to engage the locking surface 106 on clutch arm 76. Thus, the clutch lever 76 is locked into the position shown in solid outline in FIG. 3 thereby disengaging the belt 18 from the motor shaft 16 by contact of the idler pulley 32 with the belt 18.

Upon the user releasing pressure from pedal 58, arm 60 moves from the position shown in solid outline in FIG. 3 upwardly to the position shown in dashed outline. Further counterclockwise rotation of the member 48 is prevented by engagement of the left side of slot 74 with the lug 94 on the clutch lever as shown in dashed outline in FIG. 3.6

It will be understood that during the belt disengagement movement, the belt 18 is stretched from the position shown in FIGS. 2 and 5 to the length shown in FIGS. 1 and 3, by virtue of the elastomeric nature of the material of the drive belt 18.

When the user desires to re-engage the driving of the roller brush 22, the lever arm 60 of actuator 48 is moved by the user depressing pedal 58 to move the actuator 48 including arm 60 from the position shown in dashed outline in FIG. 3 to the lowered or clockwise rotated position shown in solid outline, whereupon the lug or tab 54 on arm 60 engages the pawl 148 on stop member 134 and rotates the member 134 in a clockwise direction until the tab 146 thereon engages the inner edge of the lower portion of member 108 as shown in dashed outline in FIG. 5, whereupon further downward movement of arm 60 and clockwise rotation of actuator 48 is prevented. Concurrently with the rotation of stop member 134 on arm locking member 108, the downward movement of the stop member 134 causes arm locking member 108 to pivot about rivet 112 and lift the tab 130 on the opposite end of locking member 108 from engagement with the locking surface 106 in on the clutch lever 76.

With the tab 134 disengaged from the locking surface 106, the line of action of the tension forces of opposing sides of the belt on the pulley 32 acts along the line AA in FIG. 3 (e.g. through the center of the roller brush 22). This line of action causes a counterclockwise moment on the clutch lever 76 about the bolt 80 causing sudden free movement of clutch lever 76 to the engaged position as shown in FIG. 5, thereby re-engaging the belt with the motor shaft 16. The counterclockwise movement of the clutch lever 76 to the position shown in FIG. 5 causes the lug 94 on clutch lever 76 to engage the right hand edge of slot 74 in actuator 48 and rotate the actuator counterclockwise to the return position shown in solid outline in FIG. 5, when the user releases pressure from the pedal 58.

Figure 8:
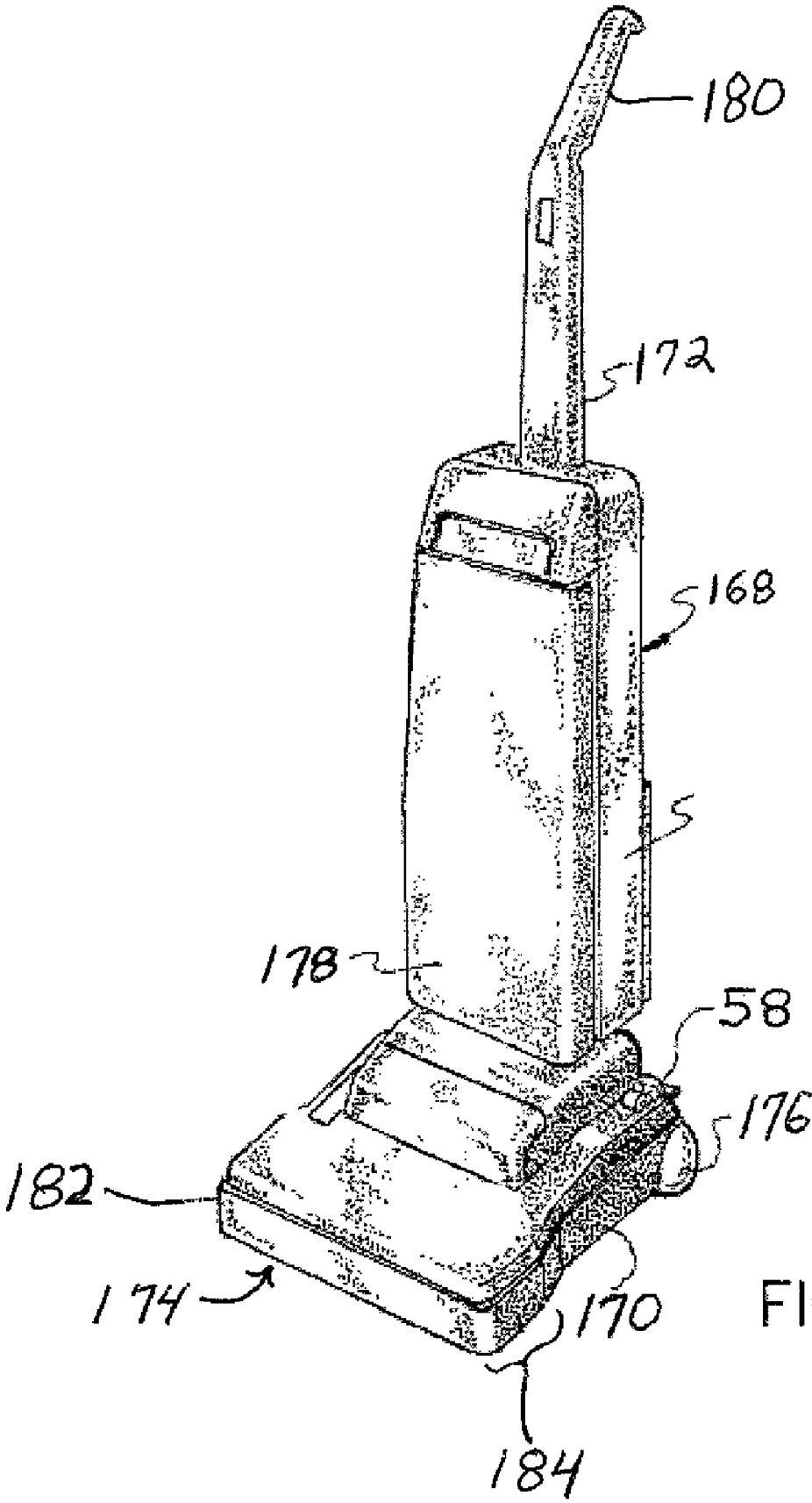
FIG. 8 is a vacuum cleaning floor cleaning appliance that can have the roller brush drive train assembly with short stroke engaging and disengaging mechanism as shown in the other FIGURES.

As shown in FIG. 8 in general according to an embodiment of the inventive disclosure an upright cleaner includes a floor engaging portion 170, and a handle portion 172 pivotally mounted with the floor engaging portion for pivotal motion relative to the floor engaging portion between a generally upright stationary position and an inclined pivotal operating position. A brush roller 22 or sometimes referred to as an agitator or beater bar is rotatably mounted in the floor engaging portion 170 for agitating a floor surface being cleaned. Also within portion 170 can be the drive motor 12 with the motor output shaft 16 and an brush roller belt 18 selectively drivingly connecting the motor to the brush roller. The engaging and disengaging mechanism as for the above-described embodiments such as those of FIGS. 1-7 are also positioned in the floor engaging portion 170. With this arrangement the drive motor can be separate from any suction source and motor for the upright cleaner. Alternatively the motor for the suction source can also be the motor for the belt drive for the brush roller. In such a case the motor is arranged such that a rotor shaft extends horizontally and out both ends of motor housing. A conventional fan (not shown) may be affixed to one end of rotor shaft (not shown) for generating suction. The other end of the rotor shaft is utilized to drive any transmission and brush roller 22 via a drive belt 18. The upright cleaner 168 can be manually propelled or self-propelled in which case the floor engaging portion 170 would also house the drive transmission. The details of the transmission 18 do not form a part of the present invention and are therefore not disclosed in detail herein. However, a suitable transmission for use with a self-propelled upright vacuum cleaner according to the present invention is disclosed in U.S. Pat. No. 3,581,591, the disclosure of which is hereby incorporated herein as of reference.

The floor engaging portion 170 also referred to as a foot usually includes a floor nozzle 174 that is fluidly connected to a dirt receptacle and the suction source (not shown). Freely rotating support wheels 176 (only one of which is visible in FIG. 8 are located to the rear and on opposite sides of the floor engaging portion 170. An upper housing 178 with handle portion 172 or just the handle portion 172 is pivotally mounted to the lower portion 170 in a conventional manner for pivotal motion from a generally upright stationary position, to an inclined pivotal operating position. A hand grip 180 may be slidably mounted to the top end of upper housing 178 for limited reciprocal motion relative thereto for any electronic controls such as an off/on switch (not shown). The nozzle body, generally indicated as 182, defines a transversely extending brush roller chamber 184 having a downward opening nozzle or suction opening 174. A rotary brush roller 22 is rotatably mounted in chamber 184 in a conventional manner with its bristles usually extending out nozzle opening 174 for agitating a surface to be cleaned.

The present disclosure thus describes a belt lifter or clutch mechanism for engaging and disengaging the roller brush of an upright vacuum cleaner in which the user need only effect a short push stroke of a foot pedal to disengage the roller brush from the motor; and, upon release, the pedal returns to a ready position. The user need only apply another short push stroke to release the mechanism and re-engage the belt 7 from the roller brush to the drive motor. The mechanism of the present disclosure thus provides a simple and easy to use clutching mechanism for enabling the user of an upright vacuum cleaner to disengage the roller brush from the drive motor and continue operation of the drive motor and vacuum generating unit to enable use of attachments for vacuuming.

The exemplary embodiment has been described with reference to the drawings presented. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

What is claimed is:

1. A vacuum cleaner comprising:

a motor including a motor shaft;

a roller brush;

a drive belt coupled to the roller brush and the motor shaft to transmit rotary motion from the motor shaft to the roller brush; and a clutch mechanism including an idler pulley movable between a first position, in which the idler pulley is disengaged from the drive belt such that the drive belt transmits rotary motion from the motor shaft to the roller brush, and a second position, in which the idler pulley engages the drive belt such that the drive belt is decoupled from the motor shaft, and an actuator coupled to the idler pulley to move the idler pulley, the actuator being actuated by a user in a direction to move the idler pulley from the first position to the second position and being actuated by the user in the same direction to move the idler pulley from the second position to the first position, wherein the actuator is depressed by the user to move the idler pulley from the first position to the second position, and wherein the actuator is also depressed by the user to move the idler pulley from the second position to the first position, and wherein depressing the actuator rotates the actuator, wherein the actuator is rotated less than 45 degrees by the user to move the idler pulley from the first position to the second position, and wherein the actuator is rotated less than 20 degrees by the user to move the idler pulley from the second position to the first position.

2. The vacuum cleaner of claim 1, wherein the actuator includes a foot pedal to facilitate actuation by the user.

3. The vacuum cleaner of claim 1, wherein the motor also generates a vacuum for cleaning.

4. A vacuum cleaner comprising:

a motor including a motor shaft;

a roller brush;

a drive belt coupled to the roller brush and the motor shaft to transmit rotary motion from the motor shaft to the roller brush; and a clutch mechanism including a clutch lever, an idler pulley supported by the clutch lever for movement between a first position, in which the idler pulley is disengaged from the drive belt such that the drive belt transmits rotary motion from the motor shaft to the roller brush, and a second position, in which the idler pulley engages the drive belt such that the drive belt is decoupled from the motor shaft, a locking member movable relative to the clutch lever, the locking member engaging the clutch lever when the idler pulley is in the second position to inhibit movement of the idler pulley to the first position, a stop member coupled to the locking member, the stop member movable relative to the locking member to disengage the locking member from the clutch lever, and an actuator movable relative to the clutch lever and the locking member, wherein, when the idler pulley is in the first position and the actuator is actuated, the actuator engages the clutch lever to move the idler pulley to the second position, and, when the idler pulley is in the second position and the actuator is actuated, the actuator engages the stop member to move the locking member out of engagement with the clutch lever.

5. The vacuum cleaner of claim 4, wherein the idler pulley is rotatably supported by the clutch lever.

6. The vacuum cleaner of claim 4, wherein the locking member pivots relative to the clutch lever to engage and disengage the clutch lever.

7. The vacuum cleaner of claim 6, further comprising a spring coupled to the locking member, wherein the spring biases the locking member into engagement with the clutch lever when the idler pulley is in the second position.

8. The vacuum cleaner of claim 4, wherein the stop member is pivotally mounted on the locking member, and wherein, when the idler pulley is in the second position and the actuator is actuated, the actuator engages the stop member to pivot the stop member into engagement with the locking member to move the locking member out of engagement with the clutch lever.

9. The vacuum cleaner of claim 8, further comprising a spring coupled to the stop member, wherein the spring biases the stop member out of engagement with the locking member.

10. The vacuum cleaner of claim 4, further comprising a first spring coupled to the actuator and a second spring coupled to the clutch lever, wherein the first spring and the second spring bias the actuator and the clutch lever, respectively, to move the idler pulley toward the first position.

11. The vacuum cleaner of claim 4, wherein the actuator defines a slot and the clutch lever includes a lug extending into the slot, and wherein, when the idler pulley is in the first position and the actuator is actuated, an edge of the slot bears against the lug to move the idler pulley to the second position.

12. The vacuum cleaner of claim 9, wherein the clutch lever includes a locking surface formed on an outer periphery and the locking member includes a tab, and wherein the tab engages the locking surface to retain the clutch lever and the idler pulley in the second position.

13. A vacuum cleaner comprising:

a motor including a motor shaft;

a roller brush;

a drive belt coupled to the roller brush and the motor shaft to transmit rotary motion from the motor shaft to the roller brush; and a clutch mechanism including a frame, a clutch lever pivotally coupled to the frame, an idler pulley rotatably supported by the clutch lever for pivotal movement with the clutch lever relative to the frame between a first position, in which the idler pulley is disengaged from the drive belt such that the drive belt transmits rotary motion from the motor shaft to the roller brush, and a second position, in which the idler pulley engages the drive belt such that the drive belt is decoupled from the motor shaft, a locking member pivotally coupled to the frame and movable relative to the clutch lever, the locking member engaging the clutch lever when the idler pulley is in the second position to inhibit movement of the idler pulley to the first position, a stop member pivotally coupled to the locking member, the stop member movable relative to the locking member to disengage the locking member from the clutch lever, and an actuator pivotally coupled to the frame and movable relative to the clutch lever and the locking member, wherein, when the idler pulley is in the first position and the actuator is actuated by a user in a direction, the actuator engages the clutch lever to move the idler pulley to the second position, and, when the idler pulley is in the second position and the actuator is actuated by the user in the same direction, the actuator engages the stop member to pivot the stop member into engagement with the locking member to move the locking member out of engagement with the clutch lever and allow movement of the idler pulley to the first position.

14. The vacuum cleaner of claim 13, wherein the actuator is depressed by the user to move the idler pulley from the first position to the second position, and wherein the actuator is also depressed by the user to allow movement of the idler pulley from the second position to the first position.

15. The vacuum cleaner of claim 13, further comprising a first spring coupled to the actuator and a second spring coupled to the clutch lever, wherein the first spring and the second spring bias the actuator and the clutch lever, respectively, to move the idler pulley toward the first position.

16. The vacuum cleaner of claim 13, further comprising:

a first spring coupled to the locking member, the first spring biasing the locking member into engagement with the clutch lever when the idler pulley is in the second position, and a second spring coupled to the stop member, the second spring biasing the stop member out of engagement with the locking member.

17. The vacuum cleaner of claim 13, wherein the actuator defines a slot and the clutch lever includes a lug extending into the slot, and wherein, when the idler pulley is in the first position and the actuator is actuated, an edge of the slot bears against the lug to move the idler pulley to the second position.

18. The vacuum cleaner of claim 13, wherein the clutch lever includes a locking surface formed on an outer periphery and the locking member includes a tab, and wherein the tab engages the locking surface to retain the clutch lever and the idler pulley in the second position.

* * * * *